United States Patent [19]

Wycklendt

[11] 4,117,441

[45] Sep. 26, 1978

[54] CURRENT LIMITING FUSE CONSTRUCTION AND METHOD

[75] Inventor: Daniel A. Wycklendt, Milwaukee, Wis.

[73] Assignee: Electric Power Research Institute, Inc., Palo Alto, Calif.

[21] Appl. No.: 787,874

[22] Filed: Apr. 15, 1977

[51] Int. Cl.[2] ..... H01H 85/08

[52] U.S. Cl. ..... 337/295; 337/159

[58] Field of Search ..... 337/159, 229, 280, 290, 337/295

[56] References Cited

U.S. PATENT DOCUMENTS 2,337,938 12/1943 Serfling et al. ..... 337/159

FOREIGN PATENT DOCUMENTS 12,170 12/1965 Japan ..... 337/295

395,038 7/1933 United Kingdom ..... 337/290

*Primary Examiner*—Harold Broome

*Attorney, Agent, or Firm*—Flehr, Hohbach, Test, Albritton & Herbert

[57] ABSTRACT

A current limiting fuse is characterized by a self-standing tubular fuse element having a high surface area-to-volume ratio to augment cooling and thus increase the steady-state current rating of the fuse and also having a plurality of axially spaced, generally diamond-shaped perforations each of which extends circumferentially somewhat less than 360°, with axially successive perforations displaced 180° apart in a circumferential direction, thereby forming a plurality of axially spaced, ring-shaped portions providing parallel arcuate current paths and with axially extending interconnections between successive pairs of ring-shaped portions disposed on diametrically opposed sides of said tubular element to thereby further increase the length of current path through said fuse element and develop a high arc voltage.

6 Claims, 5 Drawing Figures

CURRENT LIMITING FUSE CONSTRUCTION AND METHOD

BACKGROUND OF THE INVENTION

This invention pertains to current limiting fuses and methods of making same, and more particularly to current limiting fuse elements of the type primarily used in sand or in other arc quenching particulate matter.

Current limiting fuses, heretofore, have employed a fusible element in the form of an elongated ribbon wrapped in spiral fashion within the fuse body in an effort to obtain an appropriate length of ribbon element necessary to produce an elongate arc path. Note FIG. 4 as an example.

In order to obtain the proper length of fuse element wound within the fuse body it has also been disposed in a zig zag pattern back and forth across the interior of the body or disposed to spiral around within the body. When a plurality of ribbon elements are spirally wound in parallel within the casing to obtain high current rating, the current paths are not separated sufficiently to prevent merging of the arcs, and consequently fuse performance is often degraded because of the resultant high current density with low arc voltage.

SUMMARY OF THE INVENTION AND OBJECTS

A current limiting fuse has a hollow casing of insulating material carrying conductive terminal elements and a self-standing, tubular fuse element connected between the terminal elements. The tubular element has a high surface area-to-volume ratio which augments heat transfer and also has a plurality of axially-spaced, generally diamond-shaped perforations which extend somewhat less than 360° around the circumference of the tubular element, and axially successive perforations are circumferentially displaced 180°, thereby forming a plurality of axially spaced, ring-shaped portions forming parallel arcuate current paths coupled in series by axially extending connections staggered on opposite sides of the tubular element. Each ring-shaped portion divides the current into electrically parallel but physically separate arcuate paths having a length substantially greater than the axial dimension thereof, and the staggering of the interconnections between ring-shaped portions further increases the current path length to consequently increase the arc voltage and improve interruption. Increased current carrying capability may easily be achieved through use of thicker fusible material for the tubular element without sacrifice of separation between the parallel current paths.

In addition, an improved method of construction of a fuse has also been provided.

In general, it is an object of the present invention to provide an improved current limiting fuse provided with a self-standing tubular fuse element having increased surface area-to-volume ratio to thereby improve heat transfer and steady-state current rating and also providing current path length substantially greater than the axial length of the fuse to thereby increase arc voltage and improve interruption.

It is a further object of the present invention to provide an improved self-standing current limiting fuse element requiring no supporting form and which can be manufactured with relative simplicity.

It is another object of the present invention to provide an improved tubular current limiting fuse element which can be readily manufactured and assembled but which also has axially spaced apart, generally diamond-shaped perforations forming arcuate electrically parallel but physically separate current paths of increased length and which are coupled in series by axially extending interconnections that occur alternatively on opposite sides of the tubular element to thereby further increase the current path length and develop a high arc voltage.

It is yet another object of the invention to provide a simple method for manufacture of current limiting fuses.

The foregoing and other objects of the invention will become more readily evident from the following detailed description of a preferred embodiment when considered in conjunction with the drawings.

DETAILED DESCRIPTION OF PREFERRED EMBODIMENTS

Figure 1:
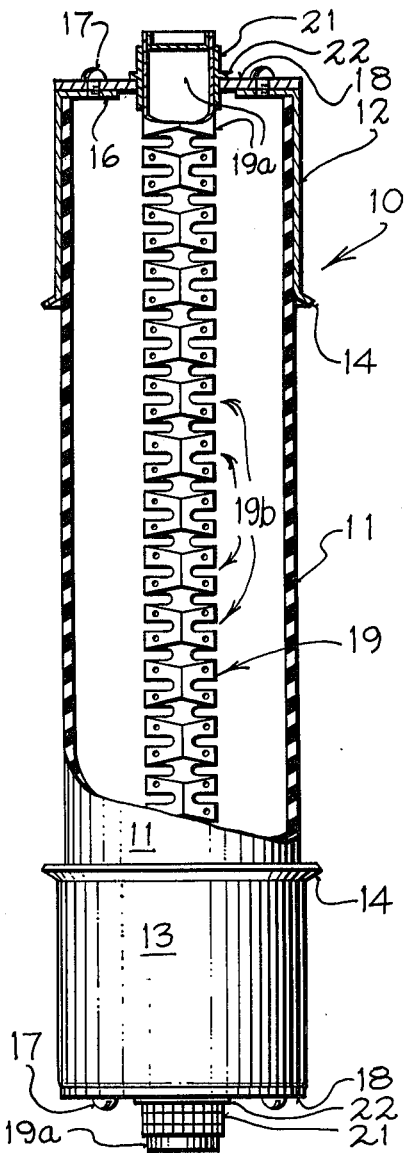
FIG. 1 shows a diagrammatic elevation view of a fuse construction according to the invention with a portion broken away for clarity.

A current limiting fuse construction 10 comprises a hollow casing 11 of insulating material. Electro conductive terminal elements or end caps 12, 13 are carried by the ends of casing 11. End caps 12, 13 each consist of a cup-shaped portion including a radially outwardly flanged end 14 serving to permit the end cap to be readily disposed onto the end of casing 11. Caps 12, 13 include a radially inwardly directed portion 16 extending across the end edge of casing 11 and formed with threaded openings adapted to receive screws 17. Screws 17 or other suitable fastening means serve to attach an end closure plate 18 to the end cap 12. End cap 13 is constructed in the same manner and accordingly need not further be described.

Figure 2:
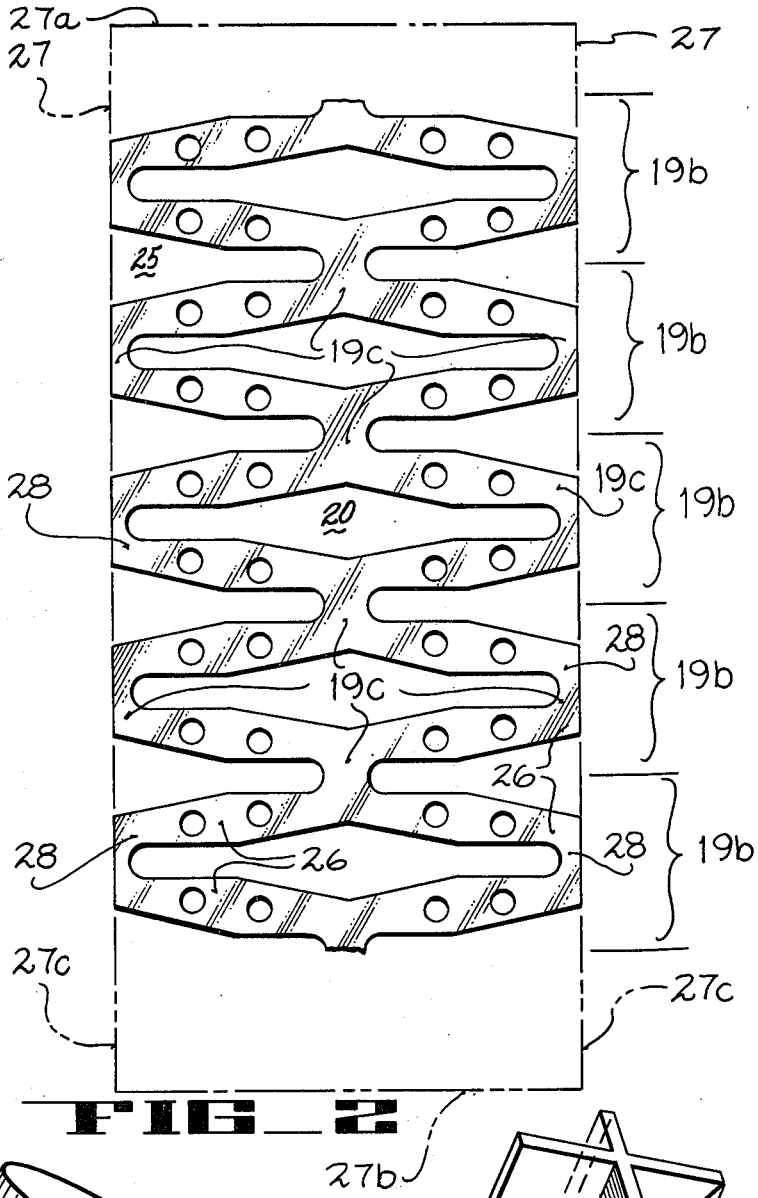
FIG. 2 shows a fuse element developed on a plane before being formed into a cylindrical shape.

Fuse 10 is characterized by a free-standing fuse element 19 formed as a cylindrical, or tubular body. A pair of mounting sleeves 21 supports the cylindrical ends **19*a* of element 19. Sleeves 21 are disposed within openings formed axially of closure plates 18 and include flanges 22 for engaging the edge margin defined about the opening through closure plates 18. Tubular fuse element 19 has a plurality of axially spaced, generally diamond-shaped perforations 20, 25 with axially-successive perforations circumferentially spaced apart (180° as shown in FIGS. 1–3 ) forming parallel arcuate current paths of increased length which are alternately interconnected in an axial direction on diametrically opposed sides of the tubular element 19** to thereby further increase the current path length and thus develop a high arc voltage.

Figure 3:
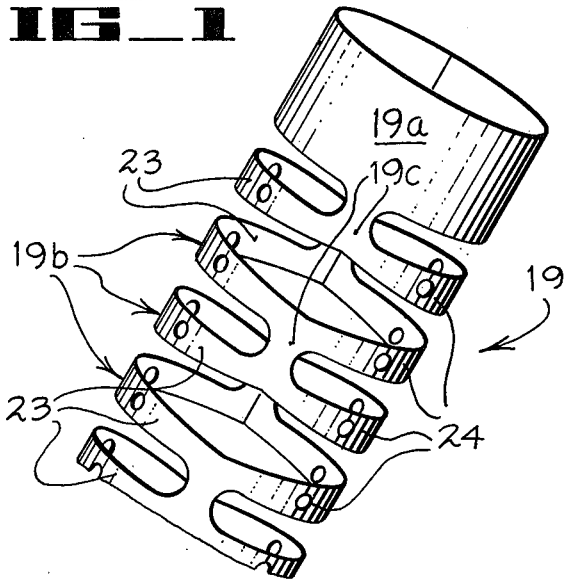
FIG. 3 shows a diagrammatic perspective view of a fuse element according to the invention.
Figure 4:
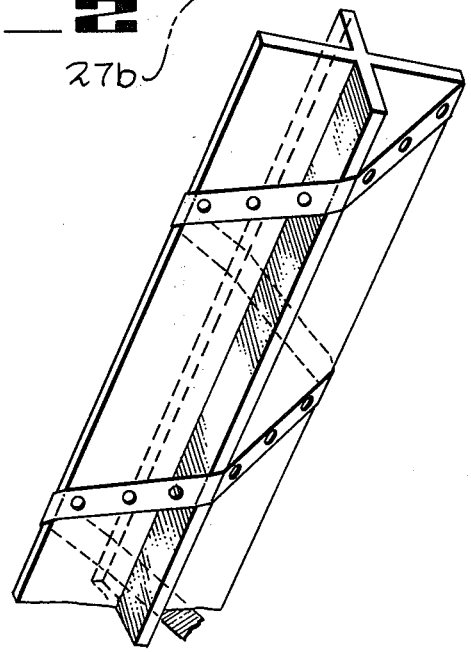
FIG 4 (PRIOR ART)
FIG. 4 shows a diagrammatic perspective view of a fuse element according to the prior art.
Figure 5:
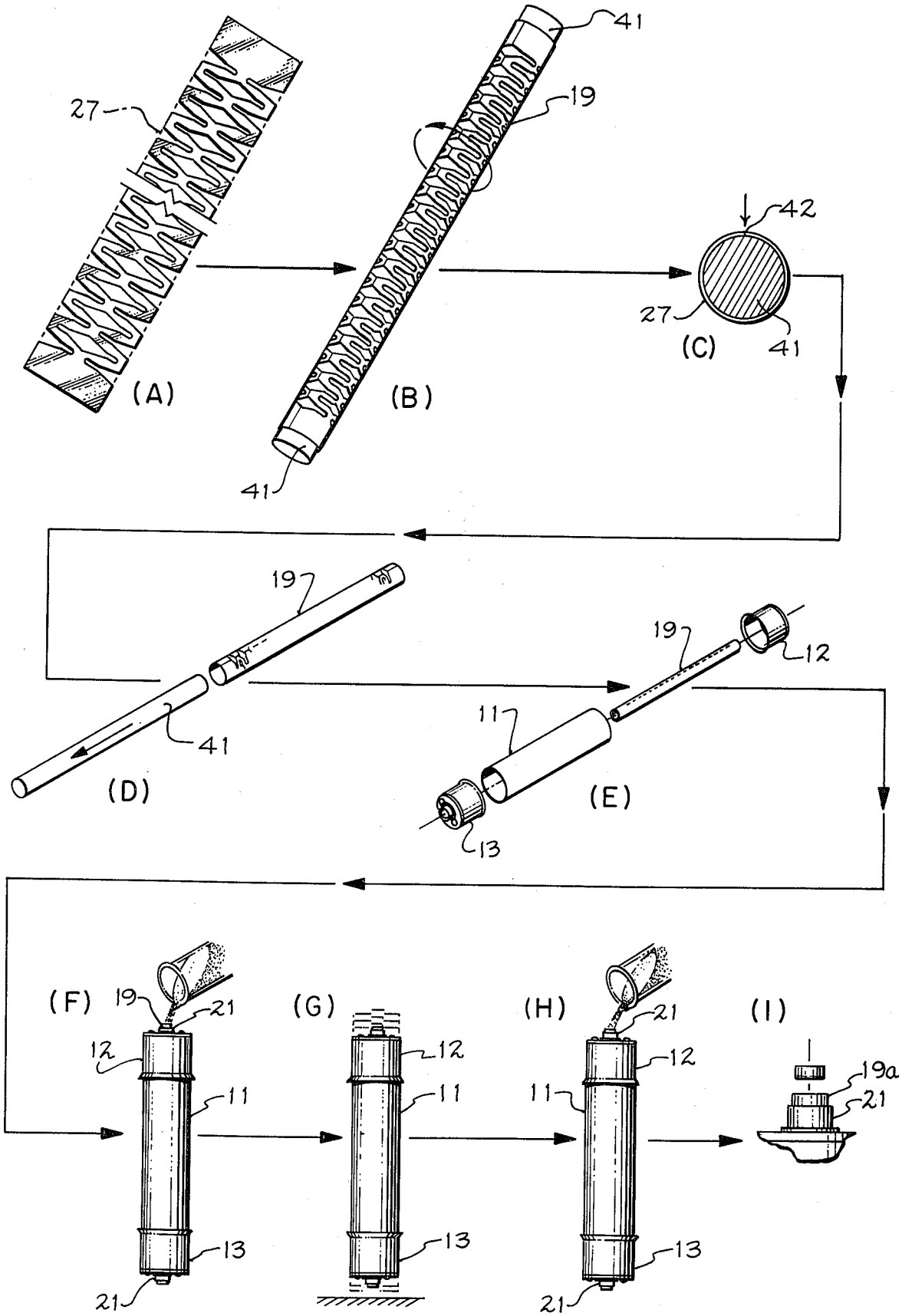
FIG. 5 shows a series of diagrammatic illustrations of steps in a method for constructing the fine construction of FIG. 1.

Fuse element 19 may be formed from a conductive sheet 27 of fusible material wrapped around a removable mandril to provide the cylindrical, or tubular semi-rigid construction shown in FIG. 3. Tubular element 19 has a plurality of axially spaced, generally diamond-shaped perforations which extend around substantially the entire circumference, but less than 360°, and axially-successive, generally diamond-shaped perforations are circumferentially displaced (180° as shown in FIGS. 1–3), thereby forming a series of generally diamond-shaped portions 19*b* coupled in series relation in an axial direction by connecting portions 19*c*. Each generally diamond-shaped portion 19*b* embraces a generally diamond-shaped perforation whose major axis is in a plane perpendicular to the axis of tubular element 19, and the minor axis thereof is in a direction parallel to the axis of tubular element 19, thereby forming four current carrying legs 26 congruent with the edges of a diamond shape and which converge into apexes 28 which are disposed along the side edges of flat sheet 27. When sheet 27 is formed into tubular configuration, apexes 28 are adjacent each other and the four legs 26 of each portion 19*b* form a pair of axially spaced, ring-shaped portions providing parallel arcuate current paths 23 and 24 having a length greater than the axial length of portion 19*b* and which are physically separated to prevent merging of the arcs which are formed upon melting. The apexes 28 in each diamond-shaped portion 19*b* interconnect the pair of ring-shaped portions thereof in a axial direction along one side of tubular element 19, while the connecting portions 19*c* interconnect successive portions 19*b* in an axial direction on the diametrically opposite side of tubular element 19, thereby further increasing the current path length. As a consequence, the length of arc formed in the arc quenching sand when element 19 melts is substantially greater than the axial length of element 19, thereby increasing the arc voltage and improving the interrupting capability of the fuse.

The preferred embodiment of making fuse element 19 follows the steps of wrapping the conductive sheet 27 of fusible material about a mandril 41 to form a cylindrically shaped fuse element 19 open at both ends. Sheet 27 is shaped to include top and bottom edges 27*a*, 27*b* when held upright as well as side edges 27*c*. The physical bounds of the side edges are defined by a series of apexes 28 defined by the laterally outwardly converging legs 26 forming the generally diamond-shaped conductive portions 19*b* of sheet 27. Mandril 41 is withdrawn from within fuse element 19 and fuse element 19 is then disposed within casing 11. A lower end cover 13 is applied to casing 11. End cover 13 includes an opening adapted to receive and retain an end of the fuse element therein. Fuse element 19 is then disposed into the opening and the next step is to secure the end within the opening. The lower end of the fuse element 19 is then closed and an upper end cover 12 disposed onto casing 11. End cover 12 also has an opening adapted to receive and retain the other (upper) end of fuse element 19.

The other (upper) end of fuse element 19 is disposed into the opening of cover 12. Then, through the open upper end 19*a* of fuse element 19 casing 11 is filled with a quantity of pulverulent, arc quenching material such as sand disposed in contact with fuse element 19 while the entire fuse construction is vibrated. The other (upper) end of fuse element 19 is secured within the last named opening, namely the top opening, in a manner as shown in FIG. 1 and it is then closed to retain the pulverulent material.

What is claimed is:

1. A current limiting fuse comprising a hollow casing of insulating material, conductive terminal elements carried by said casing, and a self-standing tubular fuse element of fusible material disposed axially of said casing and connected between said terminal elements, a plurality of axially spaced, generally diamond-shaped perforations formed through said fuse element with their major axes disposed in spaced planes substantially perpendicular to the axis of said fuse element, said perforations being axially distributed in succession and spaced apart circumferentially of said fuse element to define a plurality of axially spaced generally ring-shaped portions distributed substantially from one end of said fuse element to the other, each said ring-shaped portion providing a pair of substantially parallel arcuate current paths extending substantially fully around said fuse element for increasing the conductive path transversely of said fuse element, interconnections disposed between successive ones of said ring-shaped portions, said inter-connections being displaced circumferentially of said fuse element for increasing the length of the current path via said element to develop a high arc voltage.

2. A current limiting fuse in accordance with claim 1 wherein each said perforation extends substantially around the entire circumference, but less than 360°, of said tubular element and said axially successive perforations are circumferentially displaced 180° to dispose said interconnections between successive pairs of ring-shaped portions on substantially diametrically opposed sides of said tubular element.

3. A current limiting fuse comprising a hollow cylindrical casing of insulating material, conductive terminals on the ends of said casing, and a self-standing tubular fuse element disposed axially of said casing and connected between said terminals, said tubular element being formed from a sheet of fusible material having spaced side and end edges, said sheet having a plurality of generally diamond-shaped portions spaced apart longitudinally of said sheet with the major axis thereof disposed laterally across the width of said sheet and the minor axes thereof disposed longitudinally of said sheet midway between the side edges thereof, each said diamond-shaped portion having an elongate perforation extending along the major axis thereof across a substantial portion of the width of said sheet, each said perforation serving to form a pair of axially spaced ring-like portions in said tubular element providing parallel arcuate current paths of increased length when said sheet is wrapped to form said tubular fuse element, said portions being distributed substantially from one end of said fuse element to the other, means forming interconnections between said diamond-shaped portions only along their minor axes successively on opposite sides of said tubular element so that succcessive pairs of said ring-shaped portions are interconnected in an axial direction via diametrically opposed positions on said tubular element to thereby increase the length of current path between said terminals to develop a high arc voltage.

4. In a current limiting fuse having a hollow cylindrical casing of insulating material, conductive terminal elements on the ends of said casing, and a self-standing tubular fuse element of fusible material disposed axially of said casing and connected between said terminal elements, said tubular fuse element having a plurality of axially spaced, generally diamond-shaped perforations with axially successive perforations being circumferentially displaced apart to form a series of axially spaced ring-like portions providing parallel current paths from one said portion to the next, said portions being distributed substantially from one of said terminal elements to the other, means interconnecting successive pairs of said ring-like portions electrically on substantially diametrically opposite sides of said fuse element to thereby further increase the current path with consequent increase in arc voltage.

5. In a current limmiting fuse in accordance with claim 4 wherein each said perforation extends substantially around the entire periphery, but less than 360°, of said tubular element and axially successive perforations are circumferentially displaced 180°.

6. The method of constructing a fuse of a type having a hollow casing of electrical insulating material comprising the steps of wrapping a sheet of fusible material about a mandril to form a cylindrically-shaped fuse element open at both ends, said sheet being shaped to include top and bottom edges when held upright and side edges, the physical bounds of said side edges substantially from top to bottom being defined by a series of apexes formed by laterally outwardly converging legs defining generally diamond-shaped conductive portions of said sheet, withdrawing said mandril from within said fuse element, disposing said fuse element within said casing, applying a lower end cover to said casing, said lower end cover having an opening therein adapted to receive and retain an end of said fuse element therein, disposing said fuse element into said opening, securing said end within said opening, closing the lower end of said fuse element, applying an upper end cover to said casing, said upper end cover having an opening therein adapted to receive and retain the other end of said fuse element, disposing said other end of said fuse element into said upper end cover, filling said casing via the last named opening with a quantity of pulverulent arc quenching material, securing said other end of said fuse element within said last named opening, and closing the same to retain said pulverulent material.

* * * * *